US011113924B2

(12) United States Patent
Wotton et al.

(10) Patent No.: US 11,113,924 B2
(45) **Date of Patent: *Sep. 7, 2021**

(54) GAMING DEVICE HAVING EXTENDING WILD SYMBOLS

(71) Applicant: IGT, Las Vegas, NV (US)

(72) Inventors: Adrian Wotton, Croydon (AU); Anton Tjioe, Wolli Creek (AU)

(73) Assignee: IGT, Las Vegas, NV (US)

( * ) Notice: Subject to any disclaimer, the term of this patent is extended or adjusted under 35 U.S.C. 154(b) by 285 days.

This patent is subject to a terminal disclaimer.

(21) Appl. No.: 15/070,885

(22) Filed: Mar. 15, 2016

(65) Prior Publication Data

US 2016/0196715 A1 Jul. 7, 2016

Related U.S. Application Data

(63) Continuation of application No. 13/793,943, filed on Mar. 11, 2013, now Pat. No. 9,293,014.

(51) Int. Cl.
*G07F 17/34* (2006.01)
*G07F 17/32* (2006.01)

(52) U.S. Cl.
CPC ..... *G07F 17/3213* (2013.01); *G07F 17/3265* (2013.01); *G07F 17/34* (2013.01)

(58) Field of Classification Search
CPC ..... G07F 17/00; G07F 17/32; G07F 17/34; G07F 17/3213; G07F 17/3265
USPC ..... 463/20
See application file for complete search history.

(56) References Cited

U.S. PATENT DOCUMENTS

| | | | |
|---|---|---|---|
| 1,978,395 | A | 10/1934 | Groetchen |
| 2,545,644 | A | 3/1951 | Benton et al. |
| 2,692,074 | A | 10/1954 | Mueller et al. |
| 3,420,525 | A | 1/1969 | Waders |
| 3,642,287 | A | 2/1972 | Lally et al. |
| 3,667,757 | A | 6/1972 | Holmberg |
| 3,735,987 | A | 5/1973 | Ohki |
| 3,889,444 | A | 6/1975 | Davis et al. |
| 4,198,052 | A | 4/1980 | Gauselmann |
| 4,258,838 | A | 3/1981 | Rockola et al. |
| 4,410,178 | A | 10/1983 | Partridge |
| 4,448,419 | A | 5/1984 | Telnaes |
| 4,513,970 | A | 4/1985 | Opresco et al. |
| 4,560,161 | A | 12/1985 | Hamano |
| 4,582,324 | A | 4/1986 | Koza et al. |
| 4,586,713 | A | 5/1986 | Abu-Shumays et al. |
| 4,618,150 | A | 10/1986 | Kimura |

(Continued)

FOREIGN PATENT DOCUMENTS

| | | |
|---|---|---|
| AU | B-7493687 | 6/1987 |
| AU | 199717601 | 9/1997 |

(Continued)

*Primary Examiner* — Jay Trent Liddle
*Assistant Examiner* — Ryan Hsu
(74) *Attorney, Agent, or Firm* — Neal, Gerber & Eisenberg LLP

(57) ABSTRACT

The present disclosure relates broadly to a gaming device operable under control of a processor together with a method of operating a gaming device. The disclosure relates particularly, although not exclusively, to a gaming device and method where a wild symbol is in the course of a plurality of games extends along at least one of a plurality of symbol reels.

13 Claims, 9 Drawing Sheets

(56) References Cited

U.S. PATENT DOCUMENTS 4,624,459 A 11/1986 Kaufman
4,648,600 A 3/1987 Olliges
4,695,053 A 9/1987 Vazquez, Jr. et al.
4,706,956 A 11/1987 Abu-Shumays et al.
4,722,527 A 2/1988 Gauselmann
4,743,022 A 5/1988 Wood
4,756,531 A 7/1988 DiRe et al.
4,805,907 A 2/1989 Hagiwara
4,817,952 A 4/1989 Biro et al.
4,823,538 A 4/1989 Takamura
4,836,546 A 6/1989 DiRe et al.
4,836,553 A 6/1989 Suttle et al.
4,838,552 A 6/1989 Hagiwara
4,844,467 A 7/1989 Gyenge et al.
4,861,041 A 8/1989 Jones et al.
4,871,171 A 10/1989 Rivero
4,874,173 A 10/1989 Kishishita
4,889,340 A 12/1989 Greene
4,991,848 A 2/1991 Greenwood et al.
5,019,973 A 5/1991 Wilcox et al.
5,033,744 A 7/1991 Bridgeman et al.
5,042,818 A 8/1991 Weingardt
5,067,712 A 11/1991 Georgilas
5,078,405 A 1/1992 Jones et al.
5,085,435 A 2/1992 Rossides
5,085,436 A 2/1992 Bennett
5,092,598 A 3/1992 Kamille
5,098,107 A 3/1992 Boylan et al.
5,102,134 A 4/1992 Smyth
5,102,137 A 4/1992 Ekiert
5,152,529 A 10/1992 Okada
5,154,429 A 10/1992 LeVasseur
5,167,413 A 12/1992 Fulton
5,178,390 A 1/1993 Okada
5,205,555 A 4/1993 Hamano
5,209,479 A 5/1993 Nagao et al.
5,211,399 A 5/1993 Howard
5,224,706 A 7/1993 Bridgeman et al.
5,249,800 A 10/1993 Hilgendorf et al.
5,257,784 A 11/1993 Boylan et al.
5,259,616 A 11/1993 Bergmanei
5,282,633 A 2/1994 Boylan et al.
5,288,077 A 2/1994 Jones
5,288,081 A 2/1994 Breeding
5,308,065 A 5/1994 Bridgeman et al.
5,332,219 A 7/1994 Marnell, II et al.
5,332,228 A 7/1994 Schultz
5,342,047 A 8/1994 Heidel et al.
5,342,049 A 8/1994 Wichinsky et al.
5,362,052 A 11/1994 Kubatsch
5,364,100 A 11/1994 Ludlow et al.
5,364,105 A 11/1994 Jones
5,373,440 A 12/1994 Cohen
5,377,973 A 1/1995 Jones et al.
5,393,057 A 2/1995 Marnell, II
5,393,061 A 2/1995 Manship et al.
5,395,111 A 3/1995 Inoue
5,407,200 A 4/1995 Zalabak
5,423,539 A 6/1995 Nagao
5,429,507 A 7/1995 Kaplan
5,431,407 A 7/1995 Hofberg et al.
5,431,408 A 7/1995 Adams
5,437,462 A 8/1995 Breeding
5,449,173 A 9/1995 Thomas et al.
5,452,899 A 9/1995 Skratulia et al.
5,456,465 A 10/1995 Durham
5,489,101 A 2/1996 Moody
5,490,670 A 2/1996 Hobert
5,494,287 A 2/1996 Manz
5,511,781 A 4/1996 Wood et al.
5,524,888 A 6/1996 Heidel
5,529,309 A 6/1996 Bartlett
5,531,440 A 7/1996 Dabrowski et al.
5,531,441 A 7/1996 Dabrowski et al.
5,536,016 A 7/1996 Thompson
5,542,669 A 8/1996 Charron et al.
5,560,603 A 10/1996 Seelig et al.
5,569,084 A 10/1996 Nicastro et al.
5,580,311 A 12/1996 Haste, III
5,584,485 A 12/1996 Jones
5,584,764 A 12/1996 Inoue
5,607,162 A 3/1997 Boylan et al.
5,611,535 A 3/1997 Tiberio
5,620,182 A 4/1997 Rossides
5,626,341 A 5/1997 Jones et al.
5,642,882 A 7/1997 Guerzini
5,642,884 A 7/1997 Pitcher
5,647,798 A 7/1997 Faleiglia
5,655,965 A 8/1997 Takemoto et al.
5,660,391 A 8/1997 Klasee
5,660,393 A 8/1997 Dreger
5,664,781 A 9/1997 Feola
5,711,525 A 1/1998 Breeding
5,720,662 A 2/1998 Holmes, Jr. et al.
D392,340 S 3/1998 DeSimone
5,722,891 A 3/1998 Inoue
5,732,948 A 3/1998 Yoseloff
5,743,524 A 4/1998 Nannicola
5,749,784 A 5/1998 Clapper, Jr.
5,752,881 A 5/1998 Inoue
5,762,552 A 6/1998 Vuong et al.
5,766,074 A 6/1998 Cannon et al.
5,769,716 A 6/1998 Saffari et al.
5,772,506 A 6/1998 Marks et al.
5,772,509 A 6/1998 Weiss
5,775,692 A 7/1998 Watts et al.
5,788,573 A 8/1998 Baerlocher et al.
5,794,964 A 8/1998 Jones et al.
5,795,225 A 8/1998 Jones et al.
5,807,172 A 9/1998 Piechowiak
5,810,361 A 9/1998 Kadlic
5,816,915 A 10/1998 Kadlic
5,816,918 A 10/1998 Kelly et al.
5,823,534 A 10/1998 Banyai
5,823,873 A 10/1998 Moody
5,823,874 A 10/1998 Adams
5,833,536 A 11/1998 Davids et al.
5,833,537 A 11/1998 Barrie
5,848,932 A 12/1998 Adams
5,851,148 A 12/1998 Brune et al.
5,855,514 A 1/1999 Kamille
5,863,041 A 1/1999 Boylan et al.
5,868,618 A 2/1999 Netley et al.
5,868,619 A 2/1999 Wood et al.
5,873,781 A 2/1999 Keane
5,882,259 A 3/1999 Holmes, Jr. et al.
5,882,261 A 3/1999 Adams
5,885,157 A 3/1999 Harada et al.
5,890,962 A 4/1999 Takemoto
5,911,418 A 6/1999 Adams
5,918,880 A 7/1999 Voigt, IV et al.
5,919,088 A 7/1999 Weiss
5,927,714 A 7/1999 Kaplan
5,934,672 A 8/1999 Sines et al.
5,935,002 A 8/1999 Falciglia
5,944,315 A 8/1999 Mostashari
5,947,820 A 9/1999 Morro et al.
5,947,821 A 9/1999 Stone
5,951,397 A 9/1999 Dickinson
5,953,127 A 9/1999 Washio et al.
5,964,463 A 10/1999 Moore, Jr.
5,967,894 A 10/1999 Kinoshita et al.
5,971,849 A 10/1999 Falciglia
5,980,384 A 11/1999 Barrie
5,984,781 A 11/1999 Sunaga
5,988,638 A 11/1999 Rodesch et al.
5,996,997 A 12/1999 Kamille
5,997,400 A 12/1999 Seelig et al.
5,997,401 A 12/1999 Crawford
6,003,867 A 12/1999 Rodesch et al.
6,004,207 A 12/1999 Wilson, Jr. et al.
6,007,066 A 12/1999 Moody
6,012,982 A 1/2000 Piechowiak et al.
6,015,344 A 1/2000 Kelly et al.

(56) References Cited

U.S. PATENT DOCUMENTS

| | | | |
|---|---|---|---|
| 6,015,346 | A | 1/2000 | Bennett |
| 6,019,369 | A | 2/2000 | Nakagawa et al. |
| 6,033,307 | A | 3/2000 | Vancura |
| 6,056,289 | A | 5/2000 | Clapper, Jr. |
| 6,056,642 | A | 5/2000 | Bennett |
| 6,059,289 | A | 5/2000 | Vamcura |
| 6,059,658 | A | 5/2000 | Mangano et al. |
| 6,062,978 | A | 5/2000 | Martino et al. |
| 6,062,980 | A | 5/2000 | Luciano |
| 6,068,552 | A | 5/2000 | Walker et al. |
| 6,086,066 | A | 7/2000 | Takeuchi et al. |
| 6,089,976 | A | 7/2000 | Schneider et al. |
| 6,089,977 | A | 7/2000 | Bennett |
| 6,089,978 | A | 7/2000 | Adams |
| 6,093,102 | A | 7/2000 | Bennett |
| 6,095,921 | A | 8/2000 | Walker et al. |
| 6,102,400 | A | 8/2000 | Scott et al. |
| 6,102,798 | A | 8/2000 | Bennett |
| 6,117,009 | A | 9/2000 | Yoseloff |
| 6,120,031 | A | 9/2000 | Adams |
| 6,120,377 | A | 9/2000 | McGinnis, Sr. et al. |
| 6,120,378 | A | 9/2000 | Moody |
| 6,126,541 | A | 10/2000 | Fuchs |
| 6,126,542 | A | 10/2000 | Fier |
| 6,135,885 | A | 10/2000 | Lermusiaux |
| 6,142,872 | A | 11/2000 | Walker et al. |
| 6,142,873 | A | 11/2000 | Weiss et al. |
| 6,142,874 | A | 11/2000 | Kodachi et al. |
| 6,142,875 | A | 11/2000 | Kodachi et al. |
| 6,146,273 | A | 11/2000 | Olsen |
| 6,149,156 | A | 11/2000 | Feola |
| 6,149,521 | A | 11/2000 | Sandusky |
| 6,155,925 | A | 12/2000 | Giobbi et al. |
| 6,159,095 | A | 12/2000 | Frohm et al. |
| 6,159,096 | A | 12/2000 | Yoseloff |
| 6,159,097 | A | 12/2000 | Gura |
| 6,159,098 | A | 12/2000 | Slomiany et al. |
| 6,162,121 | A | 12/2000 | Morro et al. |
| 6,165,070 | A | 12/2000 | Nolte et al. |
| 6,168,520 | B1 | 1/2001 | Baerlocher et al. |
| 6,168,523 | B1 | 1/2001 | Piechowiak et al. |
| 6,173,955 | B1 | 1/2001 | Perrie et al. |
| 6,174,233 | B1 | 1/2001 | Sunaga et al. |
| 6,174,235 | B1 | 1/2001 | Walker et al. |
| 6,179,711 | B1 | 1/2001 | Yoseloff |
| 6,186,894 | B1 | 2/2001 | Mayeroff |
| 6,190,254 | B1 | 2/2001 | Bennett |
| 6,190,255 | B1 | 2/2001 | Thomas et al. |
| 6,200,217 | B1 | 3/2001 | Osawa |
| 6,203,409 | B1 | 3/2001 | Kennedy et al. |
| 6,203,428 | B1 | 3/2001 | Giobbi et al. |
| 6,203,429 | B1 | 3/2001 | Demar et al. |
| 6,210,279 | B1 | 4/2001 | Dickinson |
| 6,213,875 | B1 | 4/2001 | Suzuki |
| 6,213,876 | B1 | 4/2001 | Moore, Jr. |
| 6,220,959 | B1 | 4/2001 | Holmes, Jr. et al. |
| 6,224,481 | B1 | 5/2001 | Okuda et al. |
| 6,224,483 | B1 | 5/2001 | Mayeroff |
| 6,227,970 | B1 | 5/2001 | Shimizu et al. |
| 6,231,442 | B1 | 5/2001 | Mayeroff |
| 6,231,445 | B1 | 5/2001 | Acres |
| 6,234,897 | B1 | 5/2001 | Frohm et al. |
| 6,238,287 | B1 | 5/2001 | Komori et al. |
| 6,238,288 | B1 | 5/2001 | Walker et al. |
| 6,241,607 | B1 | 6/2001 | Payne et al. |
| 6,251,013 | B1 | 6/2001 | Bennett |
| D445,841 | S | 7/2001 | Sabo |
| 6,261,177 | B1 | 7/2001 | Bennett |
| 6,270,408 | B1 | 8/2001 | Sakamoto |
| 6,270,409 | B1 | 8/2001 | Shuster |
| 6,270,411 | B1 | 8/2001 | Gura et al. |
| 6,270,412 | B1 | 8/2001 | Crawford et al. |
| 6,287,194 | B1 | 9/2001 | Okada et al. |
| 6,290,600 | B1 | 9/2001 | Glasson |
| 6,296,568 | B1 | 10/2001 | Tracy |
| 6,299,165 | B1 | 10/2001 | Nagano |
| 6,299,170 | B1 | 10/2001 | Yoseloff |
| 6,302,398 | B1 | 10/2001 | Vecchio |
| 6,302,790 | B1 | 10/2001 | Brossard |
| 6,305,686 | B1 | 10/2001 | Perrie et al. |
| 6,309,300 | B1 | 10/2001 | Glavich |
| 6,312,334 | B1 | 11/2001 | Yoseloff et al. |
| 6,315,660 | B1 | 11/2001 | DeMar et al. |
| 6,315,663 | B1 | 11/2001 | Sakamoto |
| 6,315,664 | B1 | 11/2001 | Baerlocher |
| 6,319,124 | B1 | 11/2001 | Baerlocher et al. |
| 6,322,078 | B1 | 11/2001 | Adams |
| 6,322,309 | B1 | 11/2001 | Thomas et al. |
| 6,328,649 | B1 | 12/2001 | Randall et al. |
| 6,334,814 | B1 | 1/2002 | Adams |
| 6,336,860 | B1 | 1/2002 | Webb |
| 6,336,863 | B1 | 1/2002 | Baeriocher et al. |
| 6,340,158 | B2 | 1/2002 | Pierce et al. |
| 6,346,043 | B1 | 2/2002 | Colin et al. |
| 6,347,996 | B1 | 2/2002 | Gilmore et al. |
| 6,358,144 | B1 | 3/2002 | Kaddlie et al. |
| 6,358,147 | B1 | 3/2002 | Jaffe et al. |
| 6,364,766 | B1 | 4/2002 | Anderson et al. |
| 6,364,768 | B1 | 4/2002 | Acres et al. |
| 6,375,187 | B1 | 4/2002 | Baerlocher |
| 6,375,570 | B1 | 4/2002 | Poole |
| 6,394,902 | B1 | 5/2002 | Glavich et al. |
| D458,311 | S | 6/2002 | Seelig et al. |
| 6,398,218 | B1 | 6/2002 | Vancura |
| 6,398,220 | B1 | 6/2002 | Inoue |
| 6,398,644 | B1 | 6/2002 | Perrie et al. |
| 6,406,369 | B1 | 6/2002 | Baerlocher et al. |
| 6,409,602 | B1 | 6/2002 | Wiltshire et al. |
| 6,413,160 | B1 | 7/2002 | Vancura |
| 6,413,161 | B1 | 7/2002 | Baerlocher et al. |
| 6,413,162 | B1 | 7/2002 | Baerlocher et al. |
| 6,416,408 | B2 | 7/2002 | Tracy et al. |
| 6,419,579 | B1 | 7/2002 | Bennett |
| 6,425,824 | B1 | 7/2002 | Baerlocher et al. |
| 6,428,412 | B1 | 8/2002 | Anderson et al. |
| 6,431,548 | B1 | 8/2002 | Voigt, IV et al. |
| 6,435,511 | B1 | 8/2002 | Vancura et al. |
| 6,439,943 | B1 | 8/2002 | Aoki et al. |
| 6,439,993 | B1 | 8/2002 | O'Halloran |
| 6,439,995 | B1 | 8/2002 | Hughs-Baird et al. |
| D463,504 | S | 9/2002 | Stephan |
| 6,443,452 | B1 | 9/2002 | Brune |
| 6,443,837 | B1 | 9/2002 | Jaffe et al. |
| 6,454,266 | B1 | 9/2002 | Breeding et al. |
| 6,454,651 | B1 | 9/2002 | Yoseloff |
| 6,461,241 | B1 | 10/2002 | Webb et al. |
| 6,464,582 | B1 | 10/2002 | Baerioeher et al. |
| 6,468,156 | B1 | 10/2002 | Hughs-Baird et al. |
| 6,471,208 | B2 | 10/2002 | Yoseloff et al. |
| 6,481,713 | B2 | 11/2002 | Perrie et al. |
| 6,491,584 | B2 | 12/2002 | Graham et al. |
| 6,494,454 | B2 | 12/2002 | Adams |
| 6,494,785 | B1 | 12/2002 | Gerrard et al. |
| 6,506,114 | B1 | 1/2003 | Estes et al. |
| 6,506,118 | B1 | 1/2003 | Baerlocher et al. |
| 6,511,375 | B1 | 1/2003 | Kaminkow |
| 6,514,141 | B1 | 2/2003 | Kaminkow et al. |
| 6,517,432 | B1 | 2/2003 | Jaffe |
| 6,517,433 | B2 | 2/2003 | Loose et al. |
| 6,537,150 | B1 | 3/2003 | Luciano et al. |
| 6,537,152 | B2 | 3/2003 | Seelig et al. |
| 6,551,187 | B1 | 4/2003 | Jaffe |
| 6,554,703 | B1 | 4/2003 | Bussiek et al. |
| 6,554,704 | B2 | 4/2003 | Nicastro et al. |
| 6,558,253 | B1 | 5/2003 | DeSimone et al. |
| 6,558,254 | B2 | 5/2003 | Baelocher et al. |
| 6,561,904 | B2 | 5/2003 | Locke et al. |
| 6,565,433 | B1 | 5/2003 | Baerlocher et al. |
| 6,565,436 | B1 | 5/2003 | Baerlocher |
| 6,569,015 | B1 | 5/2003 | Baerlocher et al. |
| 6,569,016 | B1 | 5/2003 | Baerlocher |
| 6,572,471 | B1 | 6/2003 | Bennett |
| 6,575,830 | B2 | 6/2003 | Baerlocher et al. |
| 6,577,473 | B1 | 6/2003 | Baerlocher |

(56) References Cited

U.S. PATENT DOCUMENTS 6,585,591 B1 7/2003 Baerlocher et al.
6,589,114 B2 7/2003 Rose
6,592,457 B1 7/2003 Frohm et al.
6,595,854 B2 7/2003 Hughs-Baird et al.
6,599,185 B1 7/2003 Kaminkow et al.
6,599,192 B1 7/2003 Baerlocher et al.
6,602,137 B2 8/2003 Kaminkow et al.
6,604,740 B1 8/2003 Singer et al.
6,605,002 B2 8/2003 Baerlocher
6,607,437 B2 8/2003 Casey et al.
6,607,438 B2 8/2003 Baerlocher et al.
6,609,974 B2 8/2003 Mead et al.
6,616,142 B2 9/2003 Adams
6,534,941 B2 10/2003 Olive
6,632,140 B2 10/2003 Berman et al.
6,632,141 B2 10/2003 Webb et al.
6,634,943 B1 10/2003 Baerlocher
6,634,945 B2 10/2003 Glavin et al.
6,637,139 B1 10/2003 Baerlocher
6,638,164 B2 10/2003 Randall et al.
6,644,663 B2 11/2003 Seelig et al.
6,644,664 B2 11/2003 Muir et al.
6,659,864 B2 12/2003 McCahn et al.
6,676,512 B2 1/2004 Fong et al.
6,712,694 B1 3/2004 Nordman
6,719,630 B1 4/2004 Seelig et al.
6,726,204 B2 4/2004 Inoue
6,729,621 B2 5/2004 Moody
6,733,389 B2 5/2004 Webb et al.
6,746,329 B1 6/2004 Duhamel
6,761,632 B2 7/2004 Bansemer et al.
6,780,109 B2 8/2004 Kaminkow
6,786,818 B1 9/2004 Rothschild et al.
6,796,903 B1 9/2004 Bryant
6,805,349 B2 10/2004 Baerlocher et al.
6,805,632 B2 10/2004 Suda
6,808,454 B2 10/2004 Gerrard et al.
6,855,055 B2 2/2005 Inoue
6,866,583 B2 3/2005 Glavich et al.
6,869,360 B2 3/2005 Marks et al.
D504,473 S 4/2005 Baerlocher
6,880,826 B2 4/2005 Inoue
6,893,018 B2 5/2005 Inoue
6,905,406 B2 6/2005 Kaminkow et al.
6,913,532 B2 7/2005 Baerlocher et al.
6,921,335 B2 7/2005 Rodgers et al.
6,932,700 B2 8/2005 Bennett et al.
6,955,600 B2 10/2005 Glavich et al.
6,960,133 B1 11/2005 Marks et al.
7,001,274 B2 2/2006 Baerlocher et al.
7,014,560 B2 3/2006 Glavich et al.
7,056,213 B2 6/2006 Ching et al.
7,070,502 B1 7/2006 Bussick et al.
7,074,127 B2 7/2006 Cuddy et al.
7,090,580 B2 8/2006 Rodgers et al.
7,094,148 B2 8/2006 Baerlocher et al.
7,169,042 B2 1/2007 Muir et al.
7,226,359 B2 6/2007 Bussick et al.
7,252,591 B2 8/2007 Van Asdale
7,396,279 B2 7/2008 Berman et al.
7,399,225 B2 7/2008 Kaminkow
7,442,123 B2 10/2008 Brill et al.
7,513,826 B2 4/2009 Cuddy
7,553,231 B2 6/2009 Cuddy
7,591,723 B2 9/2009 Cregan et al.
7,674,180 B2 3/2010 Graham et al.
7,758,414 B1 7/2010 Marks et al.
7,789,755 B2 9/2010 Davis et al.
7,862,430 B2 1/2011 Baerlocher et al.
8,002,625 B2 8/2011 Maya
8,043,155 B2 10/2011 Singer et al.
8,092,302 B2 1/2012 Cuddy et al.
8,105,151 B2 1/2012 Caputo et al.
8,137,179 B2 3/2012 Jensen et al.
8,142,280 B2 3/2012 Walker et al.
8,152,630 B2 4/2012 Cohen
8,216,062 B2 7/2012 Baerlocher et al.
8,241,107 B2 8/2012 Moroney
8,251,798 B2 8/2012 Belger et al.
8,262,469 B2 9/2012 Iddings et al.
8,277,307 B2 10/2012 Jensen et al.
8,366,538 B1 2/2013 Saunders et al.
8,376,836 B2 2/2013 Baerlocher et al.
8,382,570 B2 2/2013 Bennett
8,382,572 B2 2/2013 Hoffman et al.
8,382,574 B2 2/2013 Marks et al.
8,388,437 B2 3/2013 Nicely et al.
8,414,380 B2 4/2013 Saunders et al.
8,419,524 B2 4/2013 Singer et al.
8,425,303 B2 4/2013 Kennedy et al.
8,449,378 B2 5/2013 Michaelson et al.
8,491,381 B2 7/2013 Nicely et al.
8,500,551 B2 8/2013 Baerlocher et al.
2001/0009865 A1 7/2001 Demar et al.
2001/0019965 A1 9/2001 Ochi
2002/0010017 A1 1/2002 Bennett
2002/0025844 A1 2/2002 Casey et al.
2002/0045475 A1 4/2002 Glavich et al.
2002/0072402 A1 6/2002 Baerlocher
2002/0094857 A1 7/2002 Meyer
2002/0142822 A1 10/2002 Baerlocher et al.
2002/0151350 A1 10/2002 Baerlocher et al.
2002/0155883 A1 10/2002 Baerlocher
2002/0193160 A1 12/2002 Tarantino
2003/0013514 A1 1/2003 Cregan et al.
2003/0040355 A1 2/2003 Baerlocher
2003/0045344 A1 3/2003 Webb et al.
2003/0045345 A1 3/2003 Berman
2003/0045348 A1 3/2003 Palmer et al.
2003/0045354 A1 3/2003 Giobbi
2003/0054875 A1 3/2003 Marks et al.
2003/0060267 A1 3/2003 Glavich et al.
2003/0060272 A1 3/2003 Glavich et al.
2003/0064768 A1 4/2003 Fier
2003/0064795 A1 4/2003 Baerlocher et al.
2003/0064802 A1 4/2003 Rodgers
2003/0069062 A1 4/2003 Shimizu
2003/0073483 A1 4/2003 Glavich et al.
2003/0162585 A1 8/2003 Bigelow et al.
2003/0203752 A1 10/2003 Kaminkow et al.
2003/0203753 A1 10/2003 Muir et al.
2003/0216165 A1 11/2003 Singer et al.
2004/0002372 A1 1/2004 Rodgers et al.
2004/0009803 A1 1/2004 Bennett et al.
2004/0012145 A1 1/2004 Inoue
2004/0014516 A1 1/2004 Inoue
2004/0014517 A1 1/2004 Inoue
2004/0018866 A1 1/2004 Inoue
2004/0026854 A1 2/2004 Inoue
2004/0033827 A1 2/2004 Gilmore et al.
2004/0036218 A1 2/2004 Inoue
2004/0038726 A1 2/2004 Inoue
2004/0038731 A1 2/2004 Englman
2004/0048646 A1 3/2004 Visocnik
2004/0048650 A1 3/2004 Mierau et al.
2004/0048652 A1 3/2004 Ching et al.
2004/0053666 A1 3/2004 Vancura
2004/0053669 A1 3/2004 Gerrard et al.
2004/0053672 A1 3/2004 Baerlocher
2004/0053676 A1 3/2004 Rodgers
2004/0072612 A1 4/2004 Rodgers et al.
2004/0137982 A1 7/2004 Cuddy et al.
2004/0147306 A1 7/2004 Randall et al.
2004/0155399 A1 8/2004 Inoue
2004/0183251 A1 9/2004 Inoue
2004/0192431 A1 9/2004 Singer et al.
2004/0195773 A1 10/2004 Masci et al.
2004/0242313 A1 12/2004 Munoz
2004/0266516 A1 12/2004 Thomas
2004/0266517 A1 12/2004 Bleich et al.
2005/0020344 A1 1/2005 Kaminkow
2005/0043083 A1 2/2005 Inoue
2005/0043084 A1 2/2005 Inoue
2005/0049035 A1 3/2005 Baerlocher et al.

(56) References Cited

U.S. PATENT DOCUMENTS

| | | | |
|---|---|---|---|
| 2005/0059478 | A1 | 3/2005 | Peterson et al. |
| 2005/0064924 | A1 | 3/2005 | Glavich |
| 2005/0070354 | A1 | 3/2005 | Baerlocher et al. |
| 2005/0075163 | A1 | 4/2005 | Cuddy et al. |
| 2005/0104298 | A1 | 5/2005 | Butcher et al. |
| 2005/0233801 | A1 | 10/2005 | Baerlocher et al. |
| 2005/0266915 | A1 | 12/2005 | Isogai et al. |
| 2005/0266917 | A1 | 12/2005 | Glavich et al. |
| 2005/0277460 | A1 | 12/2005 | Inoue |
| 2006/0030392 | A1 | 2/2006 | Rodgers et al. |
| 2006/0040728 | A1 | 2/2006 | Fuller |
| 2006/0046830 | A1 | 3/2006 | Webb |
| 2006/0068881 | A1 | 3/2006 | Casey |
| 2006/0068884 | A1 | 3/2006 | Baerlocher et al. |
| 2006/0073876 | A1 | 4/2006 | Cuddy |
| 2008/0064481 | A1 | 3/2008 | Jackson et al. |
| 2008/0108411 | A1 | 5/2008 | Jensen et al. |
| 2008/0188286 | A1* | 8/2008 | Jaffe ..... G07F 17/3265 463/20 |
| 2008/0234032 | A1 | 9/2008 | Brunet de Courssou et al. |
| 2010/0016061 | A1 | 1/2010 | Gomez et al. |
| 2010/0081497 | A1 | 4/2010 | Wolf et al. |
| 2010/0113122 | A1 | 5/2010 | Walker et al. |
| 2010/0130280 | A1 | 5/2010 | Arezina et al. |
| 2010/0137056 | A1 | 6/2010 | Hoffman et al. |
| 2010/0197377 | A1 | 8/2010 | Aoki et al. |
| 2011/0003627 | A1 | 1/2011 | Nicely et al. |
| 2011/0053675 | A1 | 3/2011 | Aoki et al. |
| 2011/0098102 | A1 | 4/2011 | Gomez et al. |
| 2012/0214580 | A1 | 8/2012 | Hoffman et al. |
| 2013/0065663 | A1* | 3/2013 | Johnson ..... G07F 17/3213 463/20 |
| 2013/0084961 | A1 | 4/2013 | Radisich et al. |
| 2013/0084962 | A1 | 4/2013 | Radisich et al. |
| 2013/0084994 | A1 | 4/2013 | Farrar |
| 2013/0150142 | A1 | 6/2013 | Caputo |
| 2016/0063805 | A1 | 3/2016 | Marks et al. |

FOREIGN PATENT DOCUMENTS

| | | |
|---|---|---|
| AU | B-4361397 | 2/1998 |
| AU | 199863553 | 10/1998 |
| AU | 199917318 | 9/1999 |
| AU | 778685 | 4/2005 |
| EP | 0060019 | 9/1982 |
| EP | 0410789 | 2/1990 |
| EP | 0737494 | 12/1994 |
| EP | 0688002 | 12/1995 |
| EP | 0798676 | 10/1997 |
| EP | 0926645 | 6/1999 |
| EP | 0944030 | 9/1999 |
| EP | 0945837 | 9/1999 |
| EP | 0981119 | 2/2000 |
| EP | 0984408 | 3/2000 |
| EP | 1039424 | 3/2000 |
| EP | 1063622 | 5/2000 |
| EP | 0984409 | 8/2000 |
| EP | 11848522 | 3/2002 |
| EP | 1296296 | 3/2003 |
| EP | 1513117 | 3/2005 |
| GB | 1464896 | 2/1977 |
| GB | 2066991 | 7/1981 |
| GB | 2072395 | 9/1981 |
| GB | 2083936 | 3/1982 |
| GB | 2084371 | 4/1982 |
| GB | 2092797 | 8/1982 |
| GB | 2096376 | 10/1982 |
| GB | 2097160 | 10/1982 |
| GB | 2101380 | 1/1983 |
| GB | 2106292 | 4/1983 |
| GB | 2117155 | 10/1983 |
| GB | 2144644 | 3/1985 |
| GB | 2170636 | 8/1986 |
| GB | 2180087 | 3/1987 |
| GB | 2181589 | 4/1987 |
| GB | 2183882 | 6/1987 |
| GB | 2193827 | 2/1988 |
| GB | 2201821 | 9/1988 |
| GB | 2202984 | 10/1988 |
| GB | 2222712 | 3/1990 |
| GB | 2226436 | 6/1990 |
| GB | 2253300 | 2/1992 |
| GB | 2322217 | 8/1998 |
| GB | 0874337 | 10/1998 |
| GB | 2328311 | 2/1999 |
| GB | 2353128 | 2/2001 |
| WO | WO/1993/003464 | 2/1993 |
| WO | WO/1997/032285 | 9/1997 |
| WO | WO/1999/010849 | 3/1999 |
| WO | WO/2000/012186 | 3/2000 |
| WO | WO/2000/032286 | 6/2000 |
| WO | WO/2000/059591 | 10/2000 |
| WO | WO/2000/066235 | 11/2000 |
| WO | WO/2000/076606 | 12/2000 |
| WO | WO2001/026019 | 4/2001 |
| WO | WO/2004/025584 | 3/2004 |

* cited by examiner

GAMING DEVICE HAVING EXTENDING WILD SYMBOLS

PRIORITY CLAIM

This application is a continuation of, claims the benefit of and priority to U.S. patent application Ser. No. 13/793,943, filed on Mar. 11, 2013, which claims the benefit of and priority to Australian Provisional Patent Application No. 2012900974, filed on Mar. 12, 2012, the entire contents of which is incorporated by reference herein.

BACKGROUND

Various slot gaming machines are known. Slot gaming machines generally include a plurality of reels. Each reel includes a plurality of symbols. The reels spin after a player places a wager on the game. The reels spin and then stop to display generated combinations of symbols on the reels. If a generated symbol or combination of symbols is a winning symbol or combination of symbols associated with an award, the player receives that award when the generated symbol or combination of symbols appears along an active payline associated with the reels or in a scatter pay. Players can become frustrated if they almost win an award when the symbols necessary for a winning combination substantially appear on the reels but are missing a symbol or are not in the proper configuration or order to produce a winning combination.

One popular game feature which attempts to resolve such frustration in these situations and increase the player's award opportunities is a wild symbol. A wild symbol changes, replaces or functions as one of the symbols on one of the reels after the reels initially spin and stop. This enables the game to change a first or non-winning combination of symbols to a second and possibly winning combination of symbols, for example, to make a winning combination or align a winning combination on an active payline.

SUMMARY

The present disclosure relates broadly to a gaming device operable under control of a processor together with a method of operating a gaming device. The disclosure relates particularly, although not exclusively, to a gaming device and method where a wild symbol is in the course of a plurality of games extends along at least one of a plurality of symbol reels.

According to one aspect of the present disclosure there is provided a gaming device operable under control of a processor, said gaming device comprising:

a plurality of games operable by a player;

a plurality of reels each including a plurality of symbol positions associated with respective of designated symbols and at least one of the designated symbols being a wild symbol whereby the processor is programmed to:

(i) in an initial of the plurality of games, determine at least one of the reels from the plurality of reels on which the wild symbol is to display in one of the symbol positions;

(ii) extend said displayed wild symbol to one or more other symbol positions of the at least one determined reels;

(iii) determine if any winning symbols or symbol combinations occurred on the plurality of reels in an initial award evaluation in said initial of the games;

(iv) in a subsequent of the plurality of games, determine if at least one of the extended wild symbols in the one or more other symbol positions from the initial game is to display in the subsequent game;

(v) continue to extend any displayed of the extended wild symbols from said subsequent of the games to one or more further symbol positions of the at least one determined reels;

(vi) determine if any winning symbols or symbol combinations occurred on the plurality of reels in a subsequent award evaluation in said subsequent of the games.

In one embodiment, the processor is programmed to extend the displayed wild symbols by replicating said wild symbol in the other symbol position. In one such embodiment, the other symbol positions in which the wild symbols are replicated are adjacent one another. In another such embodiment, the further symbol positions in which the wild symbols are replicated are adjacent said one of the symbol positions in which the wild symbol is displayed in said initial of the games. Alternatively the processor is programmed to extend the displayed wild symbols by expanding the wild symbol along the other symbol positions being adjacent said one of the symbol positions and adjacent one another.

In one embodiment, the processor is programmed to extend the displayed wild symbols by persistently extending the wild symbols in subsequent of a series of the plurality of games. In one such embodiment, the persistently extended wild symbols progressively wrap around the determined reel.

In one embodiment, the processor is programmed in the initial game to extend the displayed wild symbols along all visible of the other symbol positions of the determined reels. In one such embodiment, the displayed wild symbols in the subsequent game extends along all visible of the further symbol positions of the determined reels.

In one embodiment, the processor is programmed to reset the extended wild symbols following a predetermined number or quantity of the plurality of games wherein the determined reel is reverted to its designed symbols at respective of its symbol positions. In one such embodiment, the predetermined number or quantity of the plurality of games is equal to the number or quantity of games triggered in a base game.

According to another aspect of the disclosure there is provided a method of operating a gaming device, said method comprising:

displaying a game operable by a player;

displaying a plurality of reels in association with the game, each of the plurality of reels including a plurality of symbol positions associated with respective of designated symbols including at least one wild symbol;

displaying the designated symbols;

in an initial of a plurality of the games, determining at least one of the reels from the plurality of reels on which the wild symbol is to display in one of the plurality of symbol positions;

extending said displayed wild symbol to one or more other symbol positions of the at least one determined reels;

determining if any winning symbols or symbol combinations occurred on the plurality of reels in an initial award evaluation in said initial of the games; in a subsequent of the plurality of games, determining if at least one of the extended wild symbols in the one or more other symbol positions from the initial game is to display in the subsequent game;

continuing to extend the displayed of the extended wild symbols from said subsequent of the games to one or more further symbol positions of the at least one determined reels;

determining if any winning symbols or symbol combinations occurred on the plurality of reels in a subsequent award evaluation in said subsequent of the games.

In one embodiment, the step of extending the displayed wild symbols involves replicating said wild symbol in the other or further symbol position. Alternatively the displayed wild symbols are expanded along the other symbol positions being adjacent said one of the symbol positions and adjacent one another.

In one embodiment, the step of extending the displayed wild symbols involves persistently extending the wild symbols in subsequent of a series of the plurality of games. In one such embodiment, the persistently extended wild symbols progressively wrap around the determined reel.

In one embodiment, the step of extending the displayed wild symbols in the initial game involves extending the displayed wild symbols along all visible of the other symbol positions of the determined reels. In one such embodiment, the displayed wild symbols in the subsequent game are extended along all visible of the further symbol positions of the determined reels.

In one embodiment, the method also comprises resetting the extended wild symbols following a predetermined number or quantity of the plurality of games wherein the determined reel is reverted to it designated symbols at respective of its symbol positions.

Additional features and advantages are described in, and will be apparent from, the following Detailed Description and the figures.

DETAILED DESCRIPTION

Figure 1A:
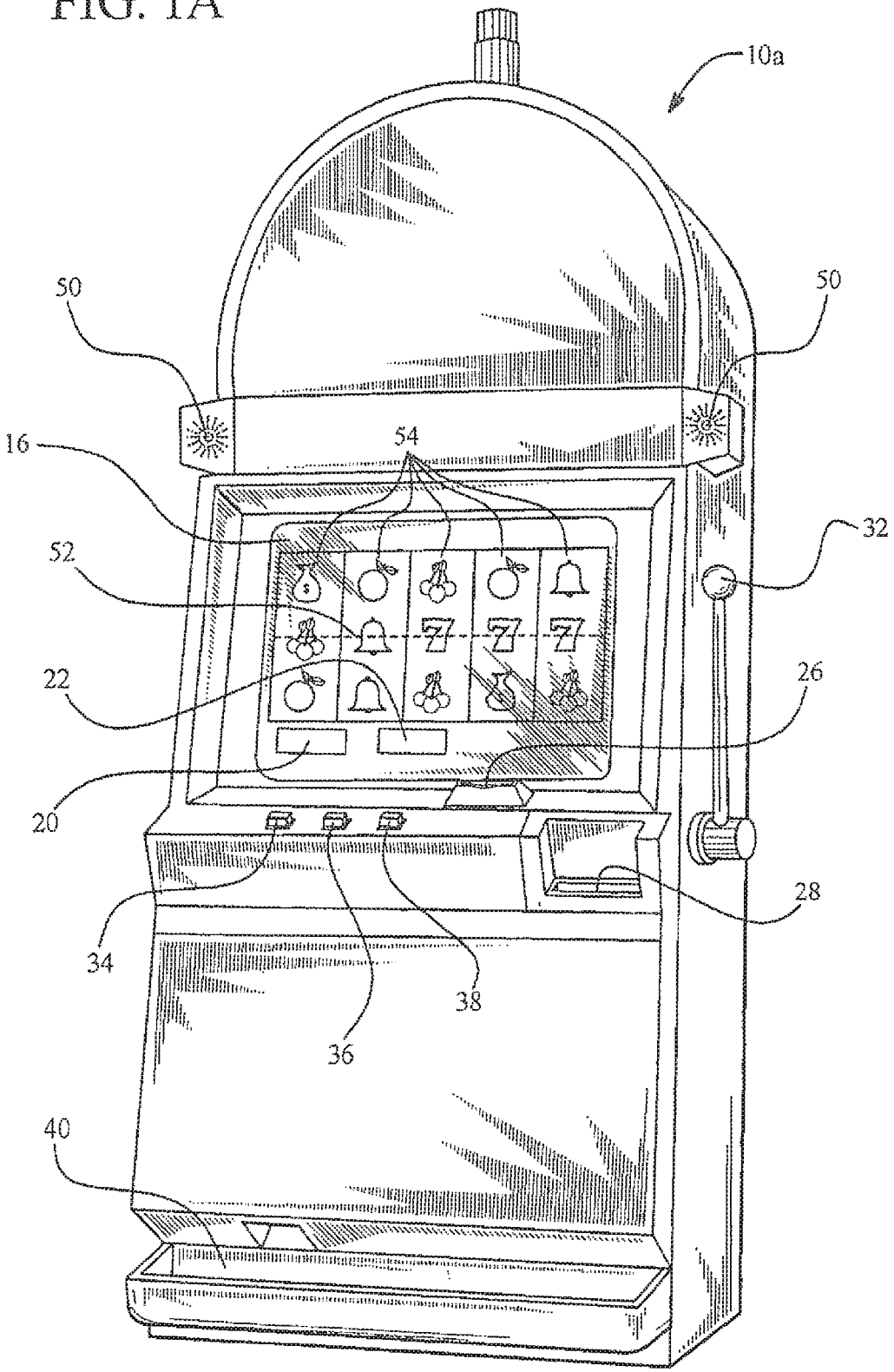
FIG. 1A is a perspective view of one embodiment of the gaming device disclosed herein.
Figure 1B:
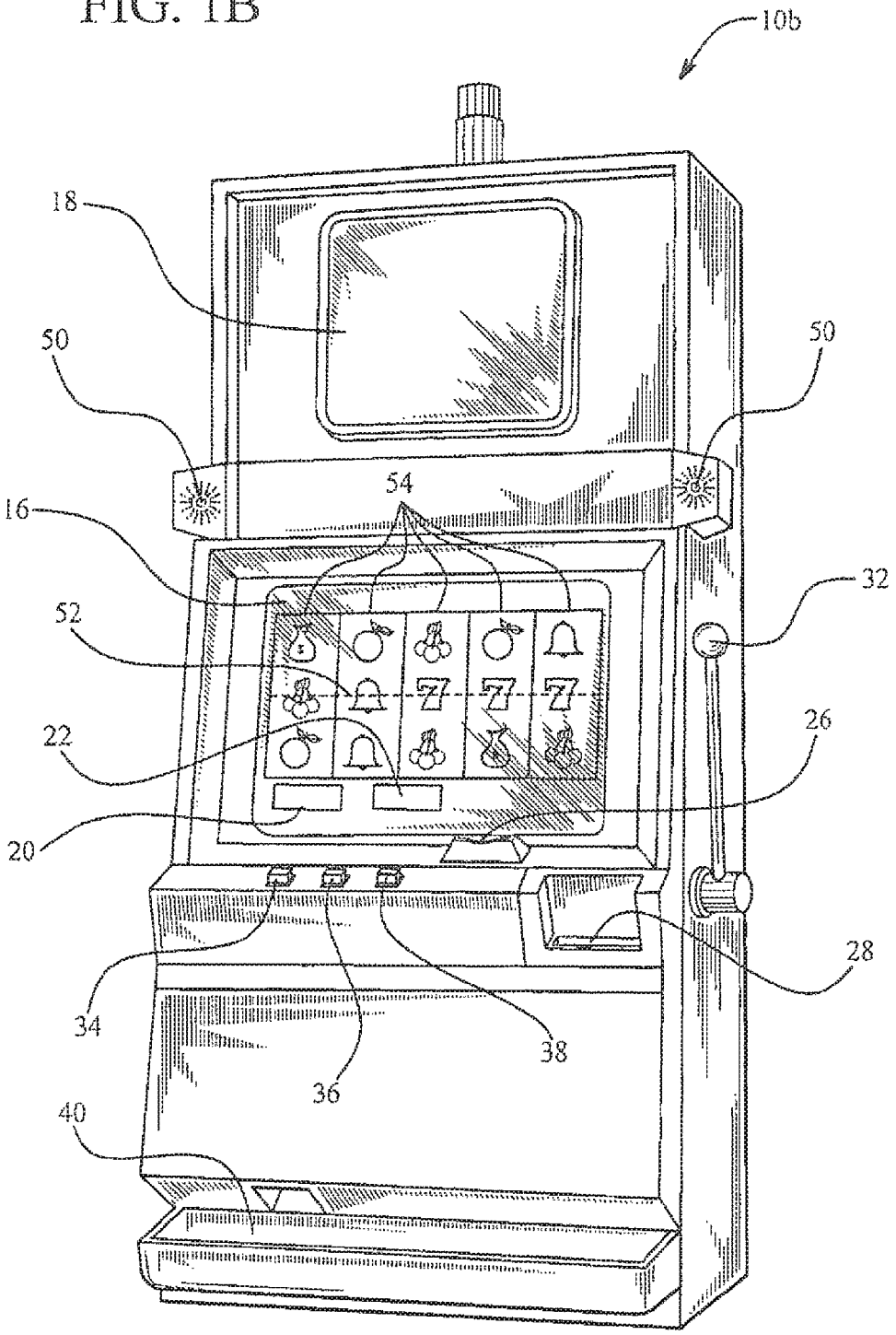
FIG. 1B is a perspective view of an alternative embodiment of the gaming device disclosed herein.

Two example alternative embodiments of the gaming device of the disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
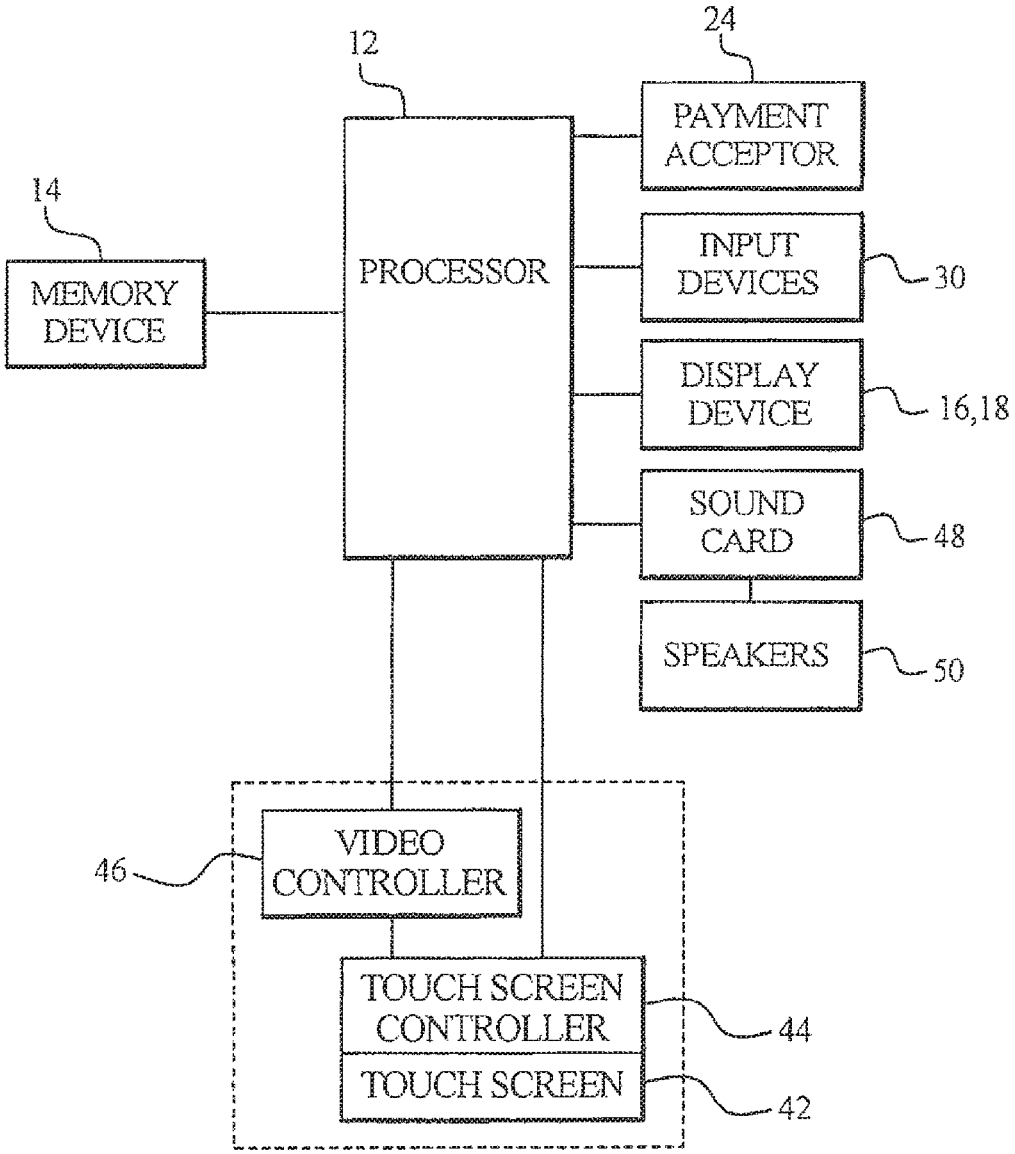
FIG. 2A is a schematic block diagram of the electronic configuration of one embodiment of the gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device 18 may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, the gaming device includes a bet display 22 which displays a player's amount wagered.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, a ticket or voucher into the payment, note or bill acceptor. In other embodiments, devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier (or other suitable redemption system) or funding to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

Gaming device 10 can incorporate any suitable wagering primary or base game. The gaming machine or device may include some or all of the features of conventional gaming machines or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager.

In a cascading or falling symbol game, symbols fall into place in respective symbol positions displayed on the display device of the gaming device. The symbols move or fall from a top of the display device instead of landing in the respective symbol positions as a plurality of reels stop sequentially (e.g., left to right).

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

Figure 2B:
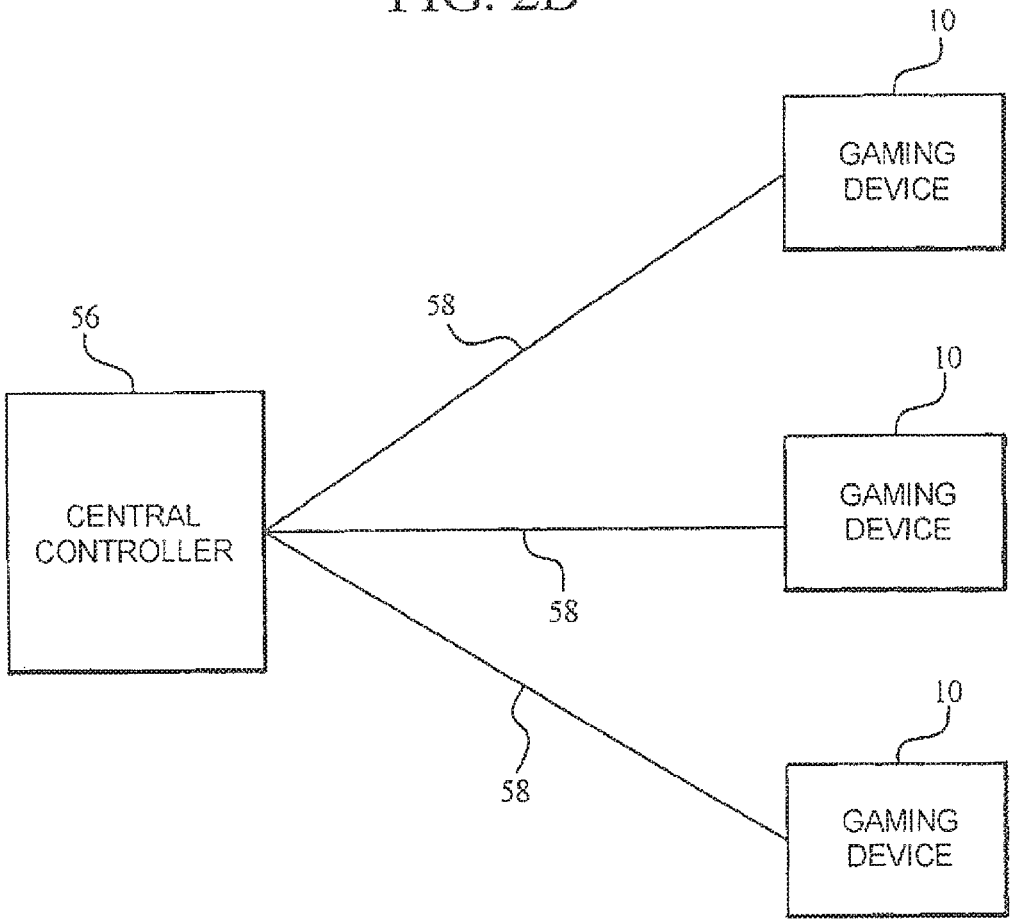
FIG. 2B is a schematic block diagram illustrating a plurality of gaming terminals in communication with a central controller.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

Figure 3:
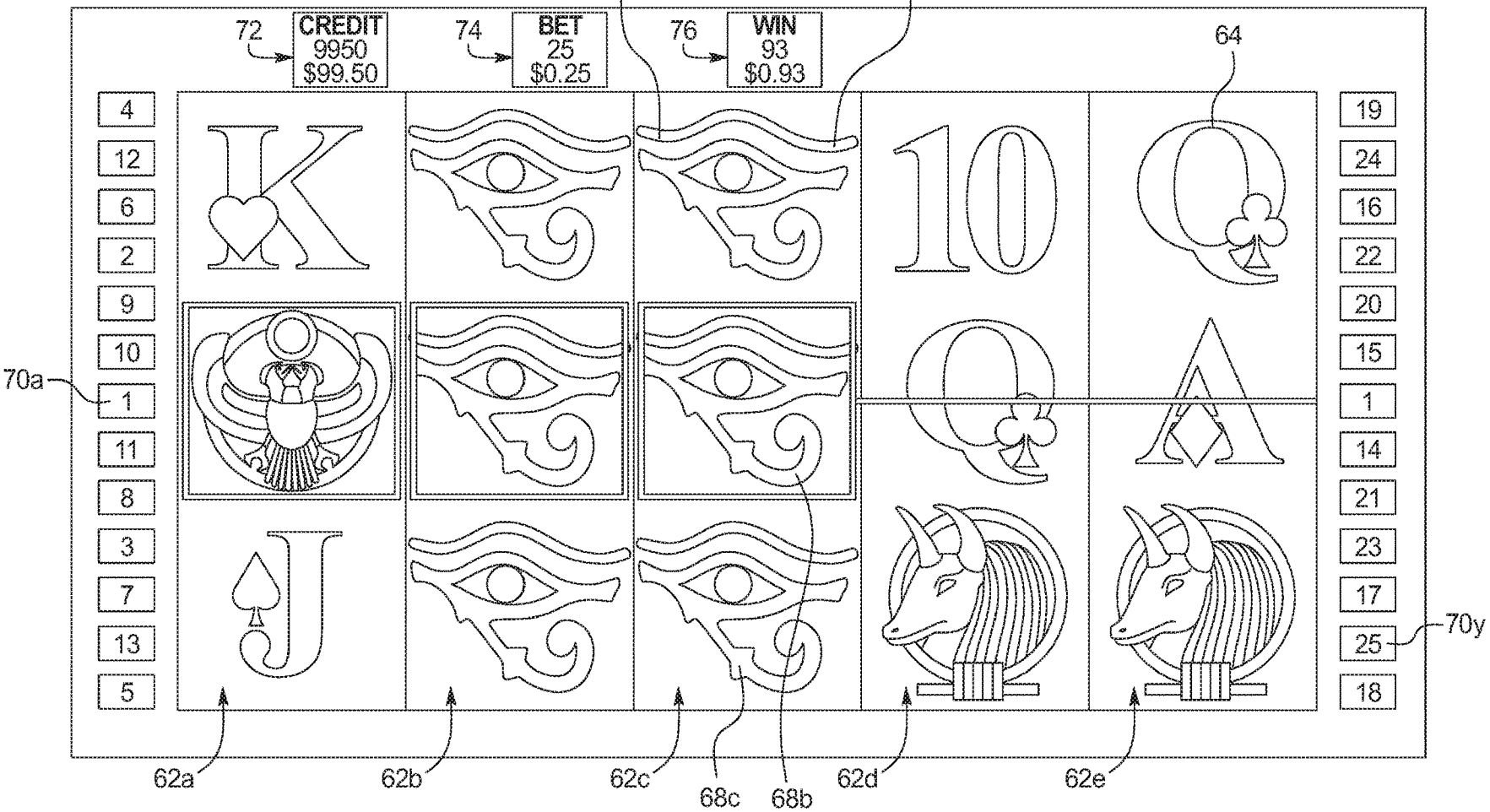
FIG. 3 is a front view of a display device of one embodiment of the gaming device according to the disclosure where in a subsequent game the display device displays a plurality of symbols on a plurality of reels.

As shown in FIG. 3 there is provided an embodiment of a gaming device according to the disclosure. This figure shows a front view of a display device 60 of this embodiment showing a plurality of symbols on one of a plurality of reels 62*a* to 62*e*. Each of the reels includes a plurality of symbols which are represented by letters, numbers or images. The symbols include a plurality of award symbols such as 64 and wild symbols such as 66. It should be appreciated that any suitable types of symbols may be employed in the gaming device.

Each symbol is positioned at a symbol position such as 68*a*, 68*b* and 68*c* of the central reel 62*c*. For each reel activation, the reels independently spin until each reel stops at a generated symbol position, that is a reel stop position. The display device 60 indicates a combination of symbols along one of a plurality of paylines such as 70*a* to 70*y*. In this example there are 25 paylines 70*a* to 70*y* each associated with a combination of five symbol positions from left to right.

A credit display 72 displays the number of credits available to the player to wager or bet on the game. A bet or wager display 74 indicates the number of credits the player wagered or bet on the game. A win display 76 indicates the total value of the awards accumulated by the player in the game. While the player's credit balance, the player's wager, and any awards are displayed as an amount of monetary credits or currency in certain of the embodiments described herein, one or more of such player's credit balance, such player's wager, and any awards provided to such a player may be for non-monetary credits, promotional credits, and/or player tracking points or credits.

Figure 4A:
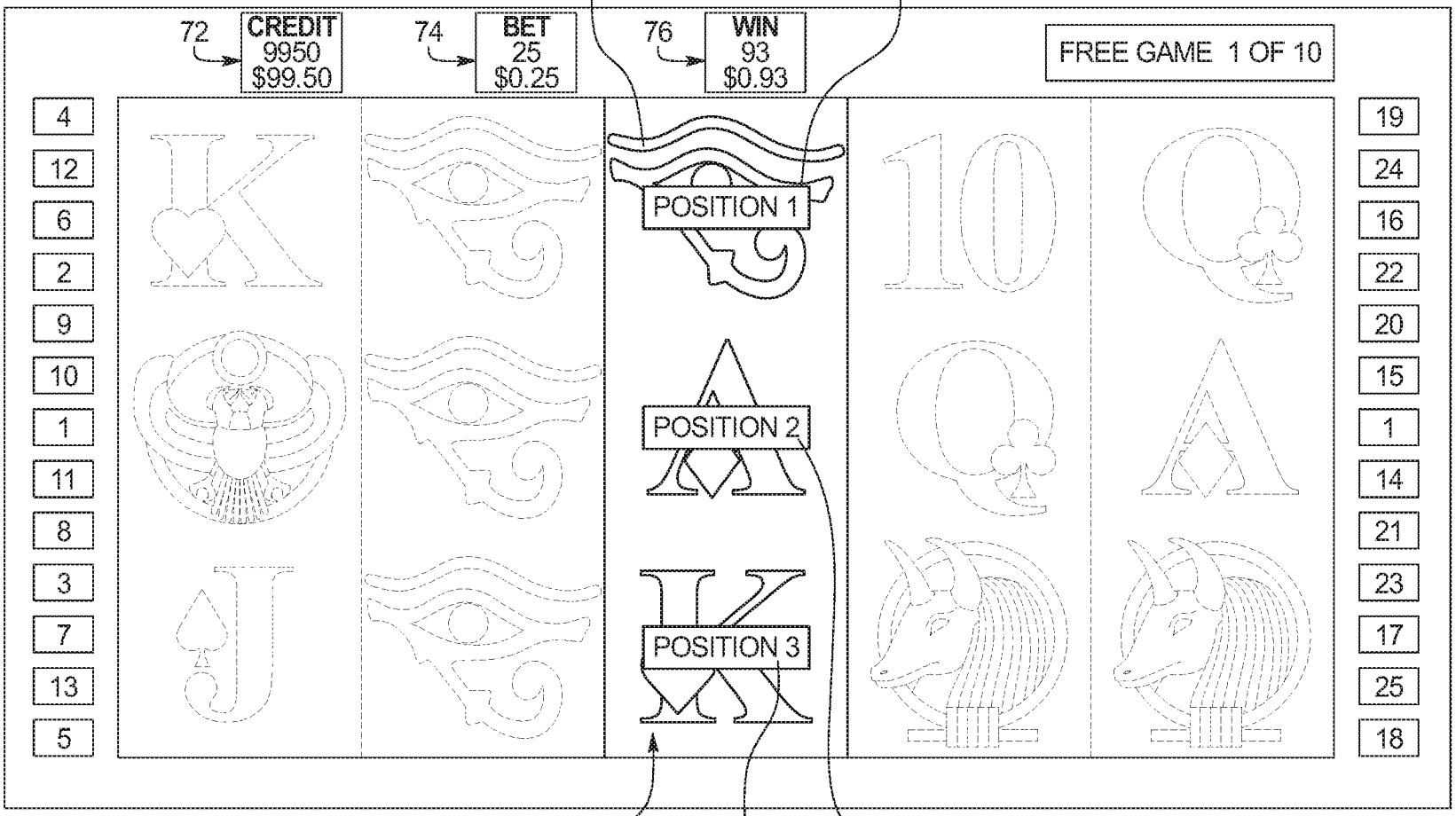
FIGS. 4A and 4B are front views of the display device of the embodiment of FIG. 3 showing the centre reel only where in an initial game the display device displays a plurality of symbols on the centre reel.

As best shown in FIG. 4A the game begins with an initial game by activating the reels 62*a* to 62*e* to display the symbols at respective stop positions. For ease of understanding the display device 60 is limited to showing one only of the reels 62*c* although in this example it will be understood that there are five reels in a five times three matrix or grid. It should be appreciated that any suitable number or quantity of reels may be employed in the game. The centre reel 62*c* is associated with a first symbol position 68*a* which displays the wild symbol 66*a*, in this example the wild EYE. The centre reel 62*c* also displays the letter A at a second symbol position 68*b* and the letter K at the third symbol position 68*c*. It should be appreciated that the other reels such as 62*a* are associated with other symbol positions which display other symbols at generated reel stop positions.

Figure 4B:
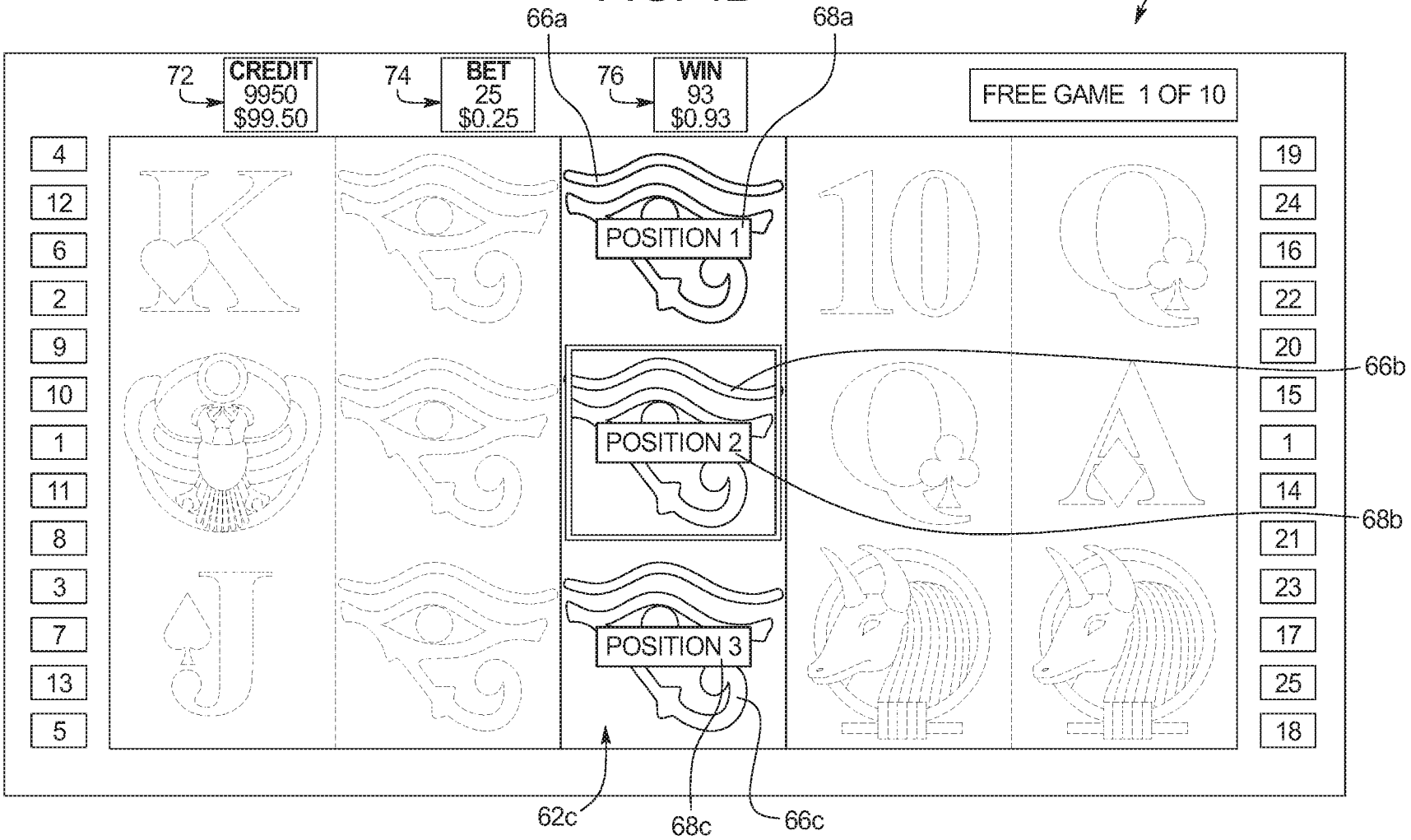

As shown in FIG. 4B the wild symbol 66*a* displayed on the central reel 62*c* in the initial game extends to symbol position two 68*b* and symbol position three 68*c* previously displaying the letters A and K, respectively. In this embodiment the wild EYE symbol 66*a* duplicates in the symbol positions two and three at 68*b* and 68*c*. The game then determines if any winning symbols or symbol combinations have occurred on the plurality of reels such as 62*a* to 62*e* in an initial award evaluation in this initial game. For example in FIG. 3 the game awards payline one 70*a* on the occurrence of three eagle-type symbols where the wild EYE symbols duplicated on reels two and three in position two substitutes for the eagle-type symbol of reel one 62A in position two.

Figure 5A:
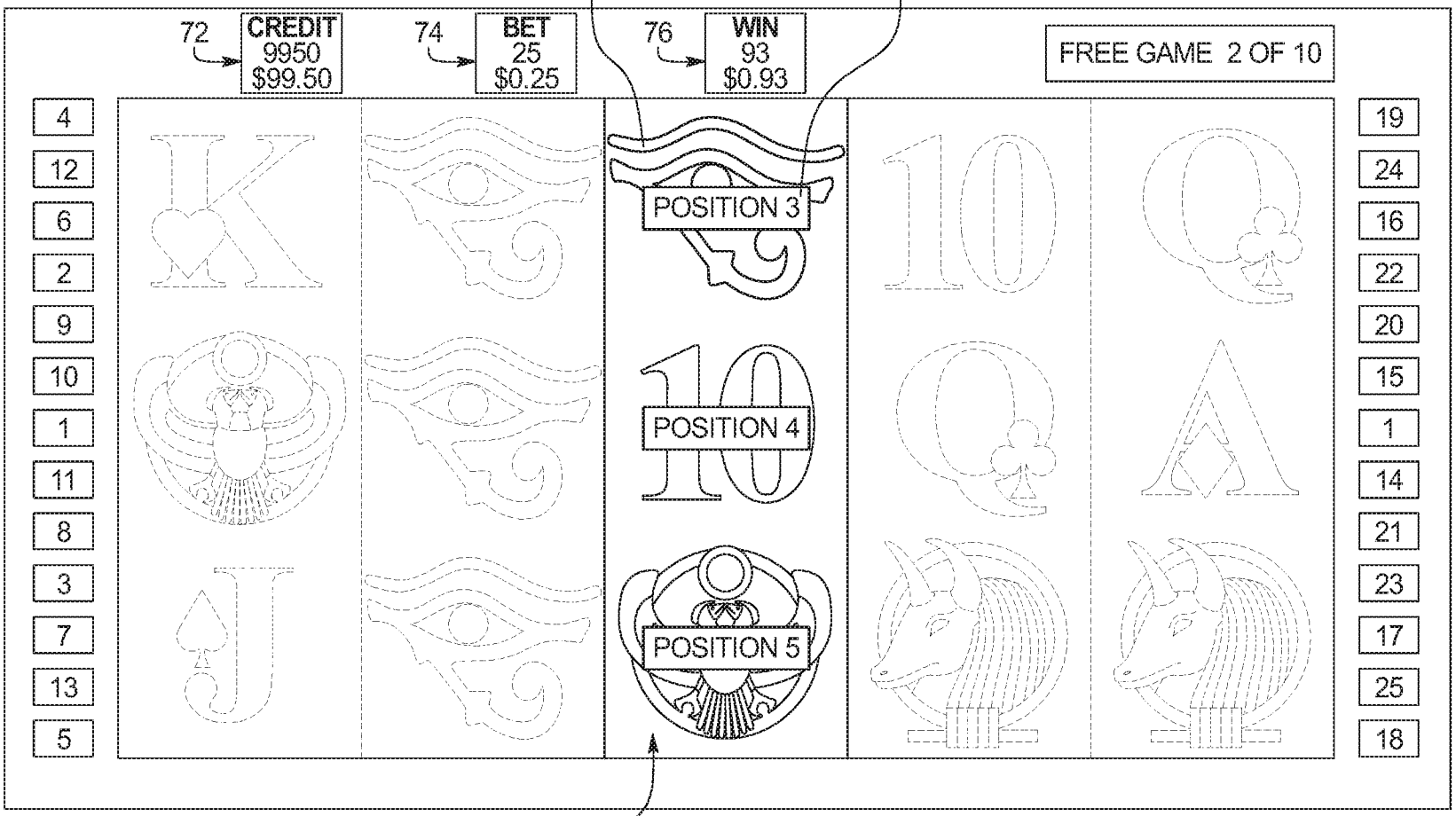
FIGS. 5A and 5B are front views of the display device of the embodiment of FIG. 3 showing the centre reel only wherein in a subsequent game the display device displays a plurality of symbols on the centre reel.

As shown in FIG. 5A in a subsequent game the central reel 62*c* spins to a stop position which displays the wild EYE symbol at symbol position three 68*c*. For clarity the display device 60 is again shown with the central reel 62*c* only. This wild EYE symbol 66*c* was duplicated from the EYE symbol 66*a* of the initial spin. The duplicated wild symbols 66*b* and 66*c* are thus retained on the central reel 62*c* in the subsequent game spin.

Figure 5B:
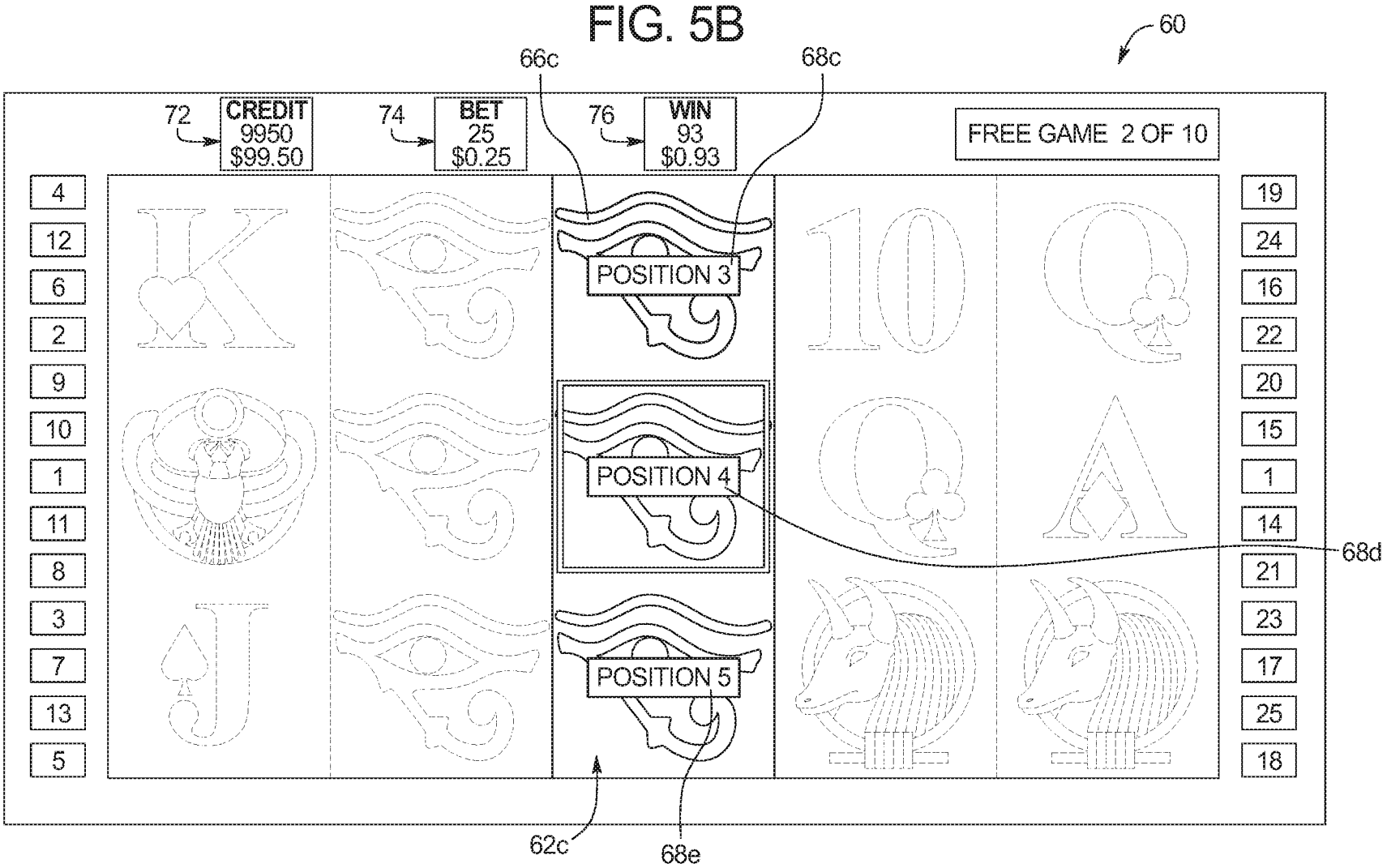

As shown in FIG. 5B the wild EYE symbol 66*c* in symbol position three 68*c* extends to the other symbol positions four and five 68*d* and 68*e*, respectively, previously occupied by the number 10 and the eagle-type symbol. In this subsequent game it is determined if any winning symbols or symbol combinations have occurred on the plurality of reels 62*a* to 62*e* in a subsequent award evaluation. During the award evaluation, the gaming device determines whether one or more winning combinations are displayed on the reel. The extension of the wild symbol generates more winning combinations for players of the gaming device. This gives players a better chance of obtaining an award while playing the gaming device.

In this embodiment the initial and subsequent games may be continued in a free game feature. As shown in FIGS. 4A/4B and 5A/5B the initial and subsequent games are games one and two of 10 free games. In this embodiment, the wild EYE symbol will each time it is displayed in the central reel 62*c* extend to the other displayed symbol positions such as 68*d* and 68*e*. The wild symbol 66 is therefore persistently extended along the determined reel such as 62*c* so that it progressively wraps around the reel 62*c*. Each of the extended or in this example duplicated wild symbols overlays or replaces one or more symbols on the determined reel and causes each replaced symbol to act as a wild symbol.

The wild symbol will in the various embodiments extend on the determined reel until one or more of the following events occur:

1. The wild symbol does not display on the determined reel;
2. The determined reel is fully occupied with the wild symbol and extended wild symbols;
3. The feature free games are complete;
4. A reset symbol reverts the determined reel to its previous designated symbols;
5. If consecutive symbols are not displayed, the determined reels are reverted to their previous designated symbols;
6. The extending wild symbols reset after a predetermined number or quantity of feature games; such as free games, if for example a predetermined award evaluation has occurred, for example the wild triples prizes or there is some other prize uplift.

In the examples described the wild symbol is extended to the visible area only of the display device such as 60. It is possible however that the wild symbol may be extended to symbol positions outside the visible symbol positions to enhance the number of possible winning hits.

It should be appreciated that the extension of wild symbols is not limited to feature games such as free spins. It may also apply to the base game as a series of consecutive occurrences. For example during the base game if a wild appears it will extend to cover all positions on that reel. All wins paid will be paid accordingly. The Wild will remain extended for the next base game spin and if it lands will extend again. Modification to the base game strips will continue as long as the wild appears on screen. Although not limited to feature games the extending wild symbol may apply to other feature games. For example, extending wild symbols could be used in re-spins where some reels are held while others are re-spun. As an alternative to free games a player may buy feature games where the bought feature games incorporate the extending wild symbols.

In the embodiment described and illustrated extension of the wild symbol is limited to reels two, three and four. It should be appreciated that extension of the wild symbol may be limited to one of the reels only or extend to all available reels. The extension to all available reels is not limited to five reels only but may apply to any reel layout or alternate arrangement of symbols on the screen display such as 60. For example, the gaming device may employ one or more uni-symbol display reels where each symbol on a display of the gaming device represents or is included on a different reel.

It is to be understood that wild symbols are equivalent to substitute symbols. If the wild symbol extends to cover additional positions on the determined reels. These positions remain substitutes for a subsequent game. In the case of free games, the extended wild symbols remain for the rest of the free games. The wild symbol is in this exampled designated with the EYE symbol but may be designated with any suitable designator or symbol. The probability of each of the symbols and in particular the wild symbol being indicated or generated on one of the reels 62*a* to 62*e* is suitably determined by the game implementor and may for example be determined based on a required return to player. The probability associated with the wild symbol displaying is less than at least one of the probabilities associated with the other symbols on the reels displaying.

The wild symbol matches or substitutes for any other symbol within the set of symbols used in the game. The wild symbol generally substitutes for one of the symbols indicated on the same payline as the wild symbol. The wild symbol may also match or substitute for the most desirable symbol on a payline such as a jackpot symbol or the symbol associated with the largest award in the game.

In the initial and subsequent award evaluation there are any number of awards associated with the symbols or combination of symbols. For example, the awards may be one or more of: one or more values, a quantity of monetary credits, a quantity of non-monetary credits, a quantity of promotional credits, a quantity of player tracking points, a progressive award, one or more modifiers, such as one or more multipliers, a quantity of free plays of one or more games, a quantity of free spins of a plurality of reels (or one or more wheels), a quantity of plays of one or more secondary or bonus games, a multiplier of a quantity of free plays of a game, one or more lottery based awards, such as lottery or drawing tickets, a wager match for one or more plays of one or more games, an increase in the average expected payback percentage of one or more plays of one or more games, one or more comps, such as a free dinner, a free night's stay at a hotel, a high value product such as a free car, or a low value product such as a free teddy bear, one or more bonus credits usable for online play, a lump sum of player tracking points or credits, a multiplier for player tracking points or credits, an increase in a membership or player tracking level, one or more coupons or promotions usable within and/or outside of the gaming establishment (e.g., a 20% off coupon for use at a convenience store), virtual goods associated with the gaming system, virtual goods not associated with the gaming system, an access code usable to unlock content on the internet, and/or any other suitable award or awards. The determination of any winning symbol combinations and evaluation of awards will continue until the game reverts to regular play wherein typically the extended wild symbols revert to their original designated symbols.

The gaming device and methodology of the present disclosure also include a wild symbol that extends across a plurality of the reels. That is, the wild symbol extends from left to right or right to left and causes at least one symbol from a plurality of the reels to act as a wild symbol. That is, the display device 60 appears in the form of an expanding wild row rather than an expanding wild column as described earlier. The extending wild symbol may be employed by a game that is displayed by either or both of the display devices 16 and 18 described above.

It should be appreciated that in different embodiments, one or more of:

i. a quantity of wild symbols associated with a play of a game;
ii. a quantity of wild symbols generated when a game is initiated;
iii. a quantity of wild symbols associated with one or more reels;
iv. which wild symbols are generated in association with which reels;
v. which symbol positions which wild symbols are generated at;
vi. which symbol positions which non-wild symbols are generated at;
vii. a direction one or more wild symbols extend;
viii. a quantity of symbol positions one or more wild symbols extend to;
ix. which symbol positions which wild symbols extend to;
x. whether a wild symbol is replicated at another symbol position;
xi. a quantity of reels one or more wild symbols extend to;
xii. which reels one or more wild symbols extend to;
xiii. a quantity of games played which one or more wild symbols persist;
xiv. which event causes a termination of the extending wild symbol feature;
xv. which symbols one or more wild symbols match or substitute for;
xvi. which symbol combinations form winning symbol combinations;
xvii. which awards are associated with which formed winning symbol combinations; and
xviii. any determination disclosed herein;

is/are predetermined, randomly determined, randomly determined based on one or more weighted percentages, determined based on a generated symbol or symbol combination, determined independent of a generated symbol or symbol combination, determined based on a random determination by the central controller, determined independent of a random determination by the central controller, determined based on a random determination at the gaming system, determined independent of a random determination at the gaming system, determined based on at least one play of at least one game, determined independent of at least one play of at least one game, determined based on a player's selection, determined independent of a player's selection, determined based on one or more side wagers placed, determined independent of one or more side wagers placed, determined based on the player's primary game wager, determined independent of the player's primary game wager, determined based on time (such as the time of day), determined independent of time (such as the time of day), determined based on an amount of coin-in accumulated in one or more pools, determined independent of an amount of coin-in accumulated in one or more pools, determined based on a status of the player (i.e., a player tracking status), determined independent of a status of the player (i.e., a player tracking status), determined based on one or more other determinations disclosed herein, determined independent of any other determination disclosed herein or determined based on any other suitable method or criteria.

The present disclosure may be implemented in various configurations for gaming machines or gaming devices, including but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by a central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

It should be understood that various changes and modifications to the presently preferred embodiments described herein will be apparent to those skilled in the art. For example, the device and method may extend to different wagering games such as video poker games, video blackjack games, video keno, video bingo or any other suitable game may be implemented. Such changes and modifications can be made without departing from the spirit and scope of the present subject matter and without diminishing its intended advantages. It is therefore intended that such changes and modifications be covered by the appended claims.

The invention is claimed as follows:

1. A dedicated electronic gaming machine comprising:
a housing;
at least one display device supported by the housing;
a plurality of input devices supported by the housing, said plurality of input devices including a payment acceptor;
at least one processor; and
at least one memory device which stores a plurality of instructions, which when executed by the at least one processor, cause the at least one processor to:
responsive to a physical item being received via the payment acceptor, establish a credit balance based, at least in part, on a monetary value associated with the received physical item, wherein the physical item is selected from the group consisting of: a ticket associated with the monetary value and a unit of currency;

cause the at least one display device to display a plurality of reels, each reel including a plurality of symbols at a plurality of reel stop positions, wherein distinct from the plurality of reel stop positions of the reels, each reel is associated with a plurality of initially displayed symbol display positions and each reel is associated with at least one initially non-displayed symbol display position, thereafter, for a play of a game, cause the at least one display device to display a first quantity of symbols by displaying, at the plurality of initially displayed symbol display positions associated with the reels, a plurality of the symbols at a plurality of the reel stop positions of the reels, for the play of the game, responsive to a wild symbol at one of the reel stop positions of one of the reels being displayed at one of the initially displayed symbol display positions associated with that reel and a wild symbol extension triggering event separately occurring:

cause the at least one display device to display a second, greater quantity of symbols by displaying, for that displayed wild symbol, an extension of that displayed wild symbol to at least one of the initially non-displayed symbol display positions associated with that reel, determine any awards associated with the displayed symbols and any wild symbols displayed at any of the initially displayed symbol display positions associated with any of the reels, and cause the at least one display device to display any determined awards, wherein the credit balance is increasable based on any determined awards, and responsive to a cashout input being received, cause an initiation of any payout associated with the credit balance.

2. The dedicated electronic gaming machine of claim 1, wherein when executed by the at least one processor for the play of the game, responsive to a plurality of wild symbols at a plurality of the reel stop positions of at least one of the reels being displayed at a plurality of the initially displayed symbol display positions associated with the at least one of the reels and the wild symbol extension triggering event separately occurring, the plurality of instructions cause the at least one processor to, for each of these displayed wild symbols, cause the at least one display device to display an extension of said displayed wild symbol to at least one of the non-initially displayed symbol display positions associated with the at least one of the reels.

3. The dedicated electronic gaming machine of claim 1, wherein when executed by the at least one processor for the play of the game, responsive to the wild symbol being displayed at the initially displayed symbol display position associated with the reel and the wild symbol extension triggering event separately occurring, the plurality of instructions cause the at least one processor to determine any awards associated with the displayed symbols and any wild symbols displayed at any of the initially displayed symbol display positions associated with any of the reels and at any of the initially non-displayed symbol display positions associated with any of the reels.

4. The dedicated electronic gaming machine of claim 1, wherein when executed by the at least one processor for a play of a subsequent game, responsive to any displayed wild symbols being extended to any other symbol display positions associated with any of the reels in the play of the game, the plurality of instructions cause the at least one processor to:

determine whether to continue to display at least one of said displayed wild symbols, and responsive to the determination being to continue to display at least one of said displayed wild symbols, cause the at least one display device to continue to display an extension of at least one of said displayed wild symbols to at least another one of the symbol display positions.

5. The dedicated electronic gaming machine of claim 1, wherein when executed by the at least one processor, the plurality of instructions cause the at least one processor to, for the displayed wild symbol, cause the at least one display device to display an extension of said wild symbol by replicating said wild symbol in the at least one initially non-displayed symbol display position associated with the at least one of the reels.

6. A gaming system server comprising:

at least one processor; and at least one memory device which stores a plurality of instructions, which when executed by the at least one processor, cause the at least one processor to:

communicate data which results in at least one display device of a mobile device displaying a plurality of reels, each reel including a plurality of symbols at a plurality of reel stop positions, wherein distinct from the plurality of reel stop positions of the reels, each reel is associated with a plurality of initially displayed symbol display positions and each reel is associated with at least one initially non-displayed symbol display position, thereafter, for a play of a game, communicate data which results in the at least one display device of the mobile device displaying a first quantity of symbols by displaying, at the plurality of initially displayed symbol display positions associated with the reels, a plurality of the symbols at a plurality of the reel stop positions of the reels, and for the play of the game, responsive to a wild symbol at one of the reel stop positions of one of the reels being displayed at one of the initially displayed symbol display positions associated with that reel and a wild symbol extension triggering event separately occurring:

communicate data which results in the at least one display device of the mobile device displaying a second, greater quantity of symbols by displaying, for that displayed wild symbol, an extension of that displayed wild symbol to at least one of the initially non-displayed symbol display positions associated with that reel, determine any awards associated with the displayed symbols and any wild symbols displayed at any of the initially displayed symbol display positions associated with any of the reels, and communicate data which results in the at least one display device of the mobile device displaying any determined awards, wherein a credit balance is increasable based on any determined awards.

7. The gaming system server of claim 6, wherein when executed by the at least one processor for the play of the game, responsive to a plurality of wild symbols at a plurality of the reel stop positions of at least one of the reels being displayed at a plurality of the initially displayed symbol display positions associated with the at least one of the reels and the wild symbol extension triggering event separately occurring, the plurality of instructions cause the at least one processor to, for each of these displayed wild symbols, communicate data which results in the at least one display device of the mobile device displaying an extension of said displayed wild symbol to at least one of the non-initially displayed symbol display positions associated with the at least one of the reels.

8. The gaming system server of claim 6, wherein when executed by the at least one processor for the play of the game, responsive to the wild symbol being displayed at the initially displayed symbol display position associated with the reel and the wild symbol extension triggering event separately occurring, the plurality of instructions cause the at least one processor to determine any awards associated with the displayed symbols and any wild symbols displayed at any of the initially displayed symbol display positions associated with any of the reels and at any of the initially non-displayed symbol display positions associated with any of the reels.

9. The gaming system server of claim 6, wherein when executed by the at least one processor for a play of a subsequent game, responsive to any displayed wild symbols being extended to any other symbol display positions associated with any of the reels in the play of the game, the plurality of instructions cause the at least one processor to:

determine whether to continue to display at least one of said displayed wild symbols, and responsive to the determination being to continue to display at least one of said displayed wild symbols, communicate data which results in the at least one display device of the mobile device continuing to display an extension of at least one of said displayed wild symbols to at least another one of the symbol display positions.

10. The gaming system server of claim 6, wherein when executed by the at least one processor, the plurality of instructions cause the at least one processor to, for the displayed wild symbol, communicate data which results in the at least one display device of the mobile device displaying an extension of said wild symbol by replicating said wild symbol in the at least one initially non-displayed symbol display position associated with the at least one of the reels.

11. The gaming system server of claim 6, wherein any determined awards cause an increase of the credit balance which is increasable via an acceptor of a physical item associated with a monetary value, and decreasable via a cashout device.

12. The gaming system server of claim 6, wherein the play of the game occurs following the receipt of data associated with a credit balance established responsive to an electronic funds transfer initiated from the mobile device.

13. The gaming system server of claim 6, wherein when executed by the at least one processor, the plurality of instructions cause the at least one processor to communicate with the mobile device through a wireless network.

* * * * *